US009797562B2

(12) United States Patent
Dabiet et al.

(10) Patent No.: US 9,797,562 B2
(45) Date of Patent: Oct. 24, 2017

(54) LED LIGHTING FIXTURE

(75) Inventors: Faiek Dabiet, Thornhill (CA); Wayne Lee, Toronto (CA); Mahsa Ajilian, Richmond Hill (CA); Horea Trifu, Toronto (CA)

(73) Assignee: ALLANSON INTERNATIONAL INC., Toronto (CA)

( * ) Notice: Subject to any disclaimer, the term of this patent is extended or adjusted under 35 U.S.C. 154(b) by 0 days.

(21) Appl. No.: 12/696,614

(22) Filed: Jan. 29, 2010

(65) Prior Publication Data

US 2010/0302778 A1 Dec. 2, 2010

(30) Foreign Application Priority Data

Apr. 23, 2009 (CA) ..... 2663852

(51) Int. Cl.
*F21V 15/00* (2015.01)
*F21S 8/02* (2006.01)
*F21Y 115/10* (2016.01)

(52) U.S. Cl.
CPC ..... *F21S 8/02* (2013.01); *F21Y 2115/10* (2016.08)

(58) Field of Classification Search
CPC ..... F21V 15/01; F21V 23/06; F21V 29/70; F21V 31/005; F21V 23/023
USPC ..... 362/362, 364–368, 382
See application file for complete search history.

(56) References Cited

U.S. PATENT DOCUMENTS

| | | | | |
|---|---|---|---|---|
| 6,290,382 | B1 * | 9/2001 | Bourn et al. | 362/554 |
| 2006/0198129 | A1 * | 9/2006 | Hagen | 362/153.1 |
| 2006/0262544 | A1 * | 11/2006 | Piepgras | F21K 9/00 362/373 |
| 2007/0230186 | A1 * | 10/2007 | Chien | F21K 9/137 362/294 |
| 2008/0180961 | A1 * | 7/2008 | Gibson | F21S 8/02 362/364 |
| 2010/0061097 | A1 * | 3/2010 | Krogman | 362/249.03 |

* cited by examiner

*Primary Examiner* — William Carter
(74) *Attorney, Agent, or Firm* — Jenna L. Wilson; Wilson Lue LLP

(57) ABSTRACT

A light fixture comprising a mounting housing comprising a junction box and a first connector component and a light housing comprising at least one light emitting diode contained within the light housing and electrically coupled to a second connector component complementary to the first connector component.

13 Claims, 4 Drawing Sheets

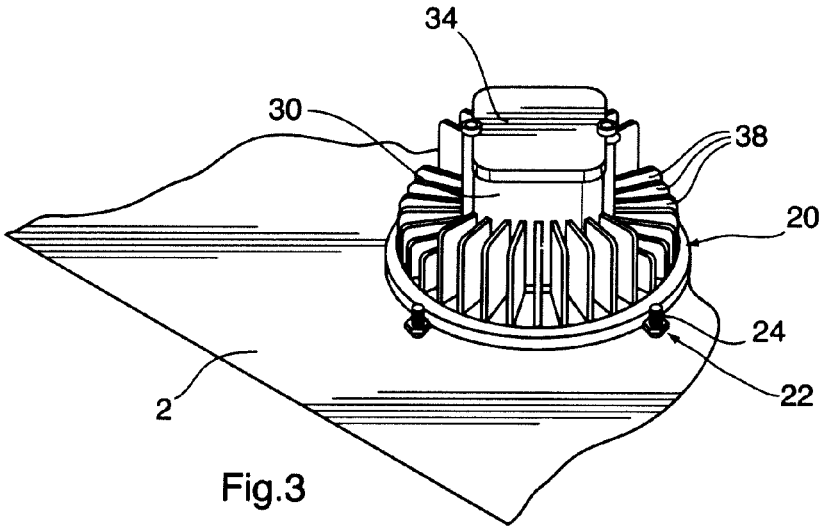
Fig.3
Fig.4
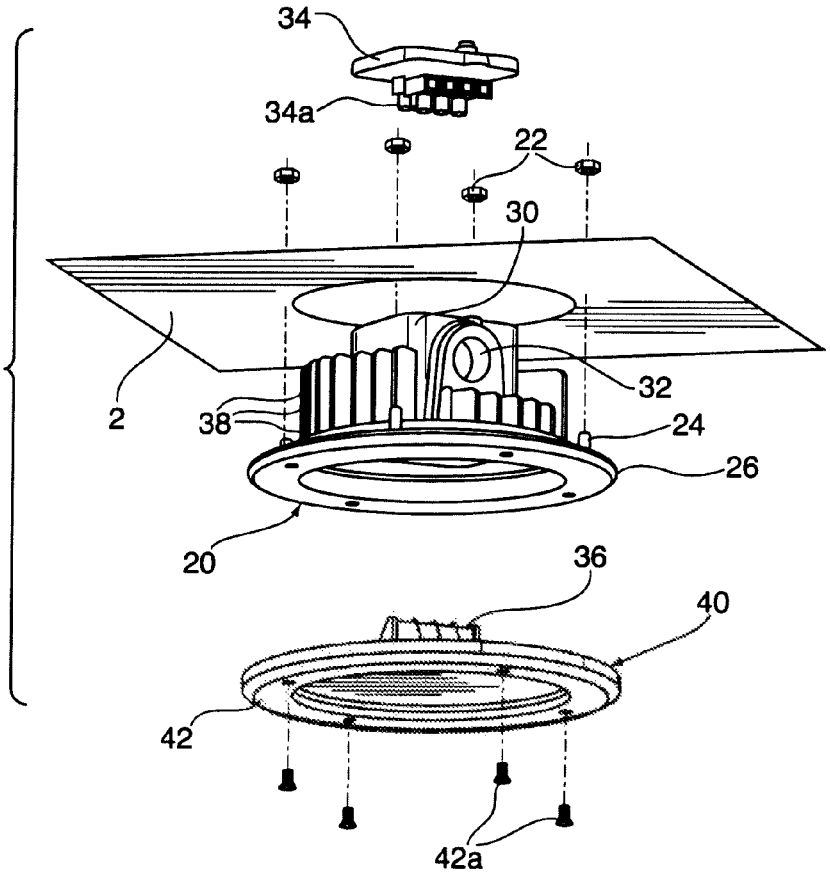

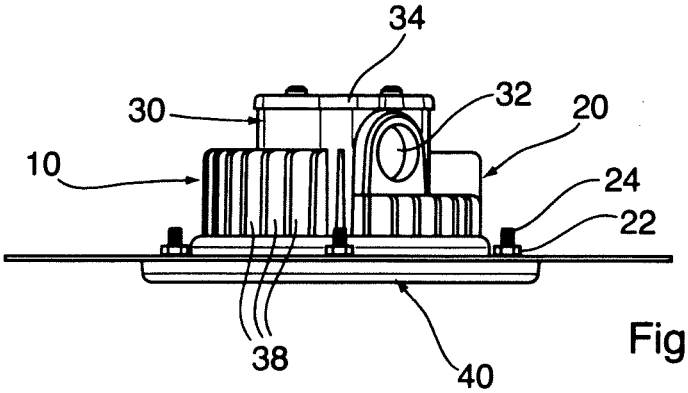
Fig.5
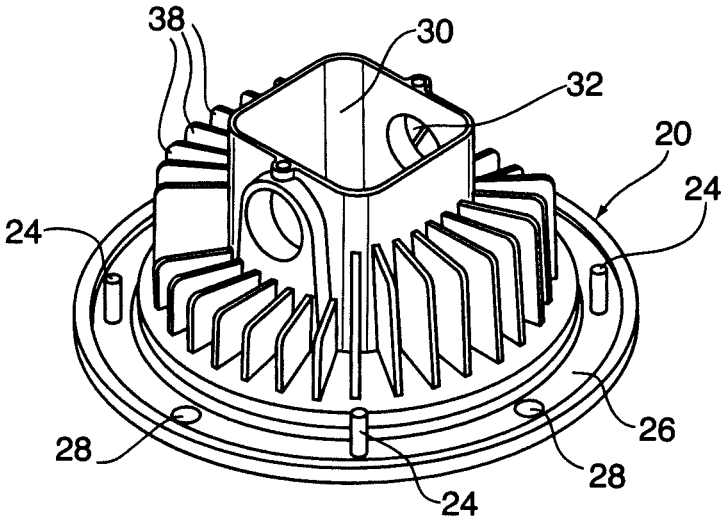
Fig.6
Fig.7
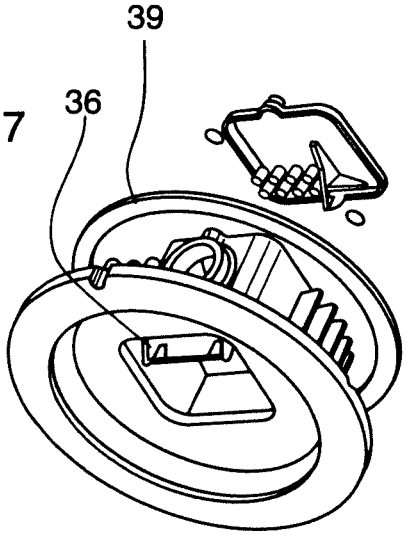

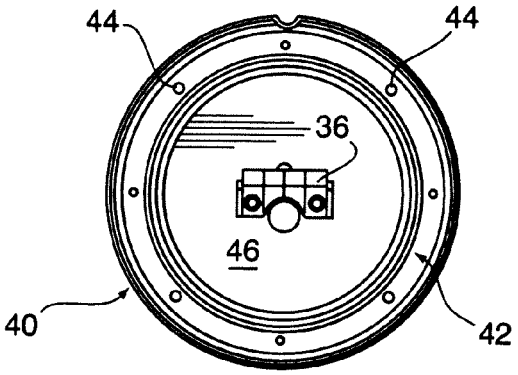
Fig.8
Fig.9
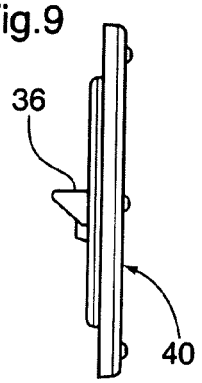
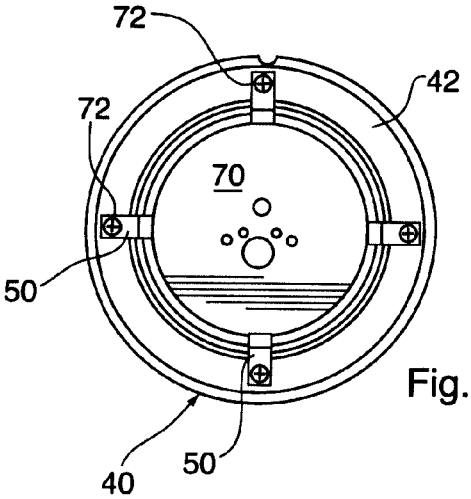
Fig.10
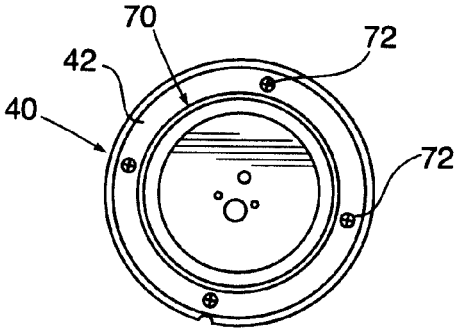
Fig.10A
Fig.11
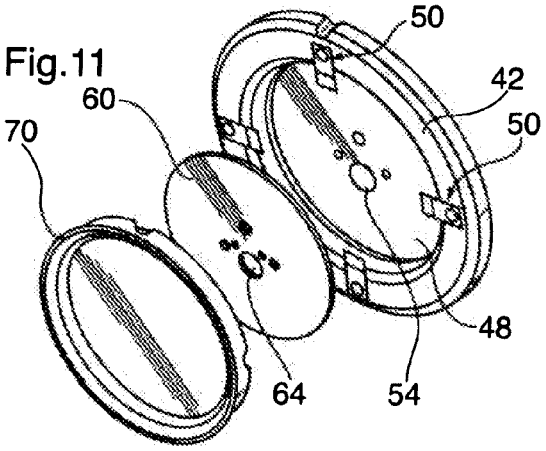
Fig.12
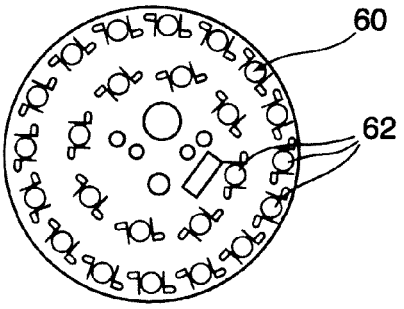

LED LIGHTING FIXTURE

FIELD OF THE INVENTION

This invention relates to lighting fixtures. In particular, this invention relates to a mounted LED light fixture.

BACKGROUND OF THE INVENTION

Lighting fixtures are used in many different applications. Indoor mounted lights in particular are used for different purposes, including ambient lighting, decorative lighting and lighting for specific work areas, often known as "task lighting." These different types of lighting have different requirements.

In addition, there are different types of light sources, including incandescent, fluorescent, and more recently, light emitting diodes (LEDs). These different types of light sources are advantageously used in different applications. Within each different type of light source there are also different colours of light, often referred to as the "colour temperature" of the light source. Thus, lighting for any particular purpose can be selected based on the type of light fixture and light source which is most suitable for the application.

LED lighting has certain advantages. LED lights consume significantly less electricity than incandescent lights, up to 80% less in some cases. Furthermore, LEDs are more durable, lasting fifty thousand to one hundred thousand hours as opposed to twenty thousand hours for average incandescent lighting. This makes LED lighting particularly suitable for certain applications were a high degree of illumination is required.

However, commensurate with the high level of illumination is a significant amount of heat which must be dissipated from the fixture. Furthermore, in certain applications where the light fixture is to be mounted into a surface which is not accessible, the light fixture must be completely self-contained including all connections to the electrical wiring, within a housing that meets all regulatory requirements. Furthermore, such a light fixture may need to be maintained or replaced and therefore access to the interior of the light fixture must be relatively easy and safe.

BRIEF DESCRIPTION OF THE DRAWINGS

In drawings which illustrate by way of example only a preferred embodiment of the invention.

FIG. 3 is a perspective view of the light fixture of FIG. 1 taken from behind a panel in which the fixture is mounted;

FIG. 4 is a partially exploded perspective view of the light fixture being mounted in the panel of FIG. 3;

FIG. 5 is a side elevation of the light fixture mounted in the panel of FIG. 3;

FIG. 6 is a rear perspective view of the mounting portion of the housing;

FIG. 7 is a partially exploded perspective view of the mounting portion of the housing taken from below;

FIG. 8 is a top plan view of a lighting portion of the housing;

FIG. 9 is a side elevation of the lighting portion of the housing in FIG. 8;

FIG. 10 is a bottom plan view of the lighting portion of the housing in FIG. 8;

FIG. 10A is a bottom plan view of a further embodiment of the lighting portion of the housing without lens retaining clips;

FIG. 11 is an exploded perspective view of the lighting portion of the housing in FIG. 8; and FIG. 12 is a bottom plan view of lighting emitters mounted to a circuit board in the lighting portion of the housing in FIG. 8.

DETAILED DESCRIPTION OF THE INVENTION

The present invention provides a high-illumination LED lighting fixture 10 for recessed mounting. The lighting fixture 10 of the invention is particularly suitable for use as task lighting in applications which require high illumination and particularly in applications where the light fixture 10 might be exposed to extremes in temperature and/or humidity, for example for lighting within a fume hood above a commercial cook top where heat and steam may be present for prolonged intervals.

Figure 1:
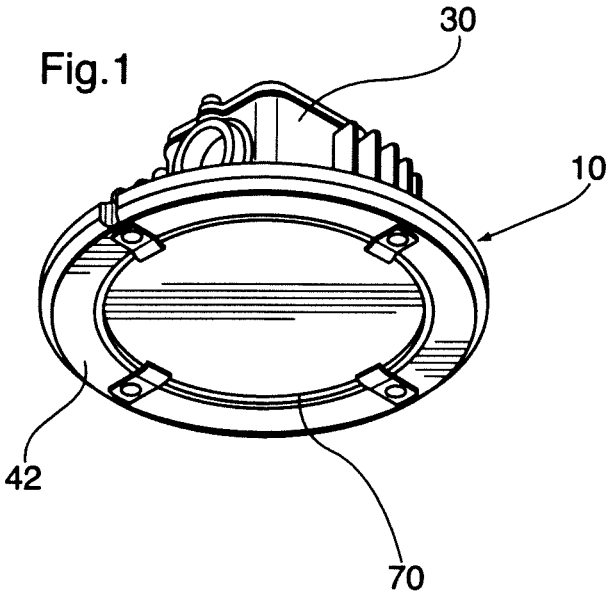
FIG. 1 is a perspective view of a light fixture according to the invention in an assembled state.
Figure 2:
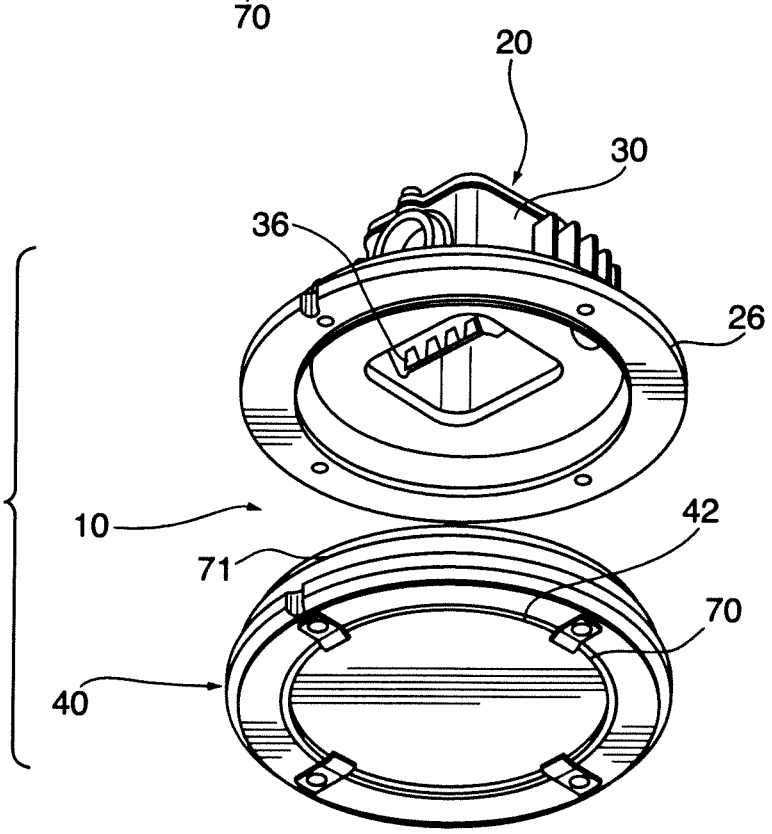
FIG. 2 is a partially exploded perspective view of the light fixture of FIG. 1.

A lighting fixture according to the invention is illustrated in FIG. 1. Lighting fixture 10 comprises two main housing components: a mounting housing 20 and a lighting housing 40, as illustrated in FIG. 2. When the fixture 10 is mounted into a surface, for example a panel 2, the mounting housing 20 of the fixture 10 is recessed behind the surface, as illustrated in FIG. 3. As shown in FIG. 4, the mounting housing 20 maybe mounted to the panel 2 prior to installation of the panel, for example by affixing nuts 22 to bolts 24 upstanding from the mounting housing flange 26. The mounted fixture 10 is shown in FIG. 5.

The mounting housing 20, best seen in FIG. 6, comprises a flange 26 circumscribing a lower portion of the housing 20, and preferably providing upstanding bolts 24 for purposes of mounting the fixture 10 as described above. The flange 26 further includes embedded nuts 28 for receiving screws 42*a* (see FIG. 4) for attaching the lighting housing 40 to the mounding housing 20. As shown in FIG. 6, the mounting housing 20 further includes a junction box 30 having at least one opening 32 for receiving conductors from a mains power supply (not shown) and a junction box cap plate 34 (seen in FIG. 4). The junction box cap plate 34 comprises terminals 34*a* for coupling the mains power supply conductors (not shown) to the male or female side of a connector 36 mounted within the junction box 30 (best seen in FIG. 7). As can be seen in the drawings, in the illustrated example the connector 36 includes a surface provided with conductive contacts. The exterior of the mounting housing 20 is provided with generally radially extending fins 38 substantially circumscribing the junction box 30, to allow for heat dissipation behind the mounting surface 2. An elastomeric (for example silicon) gasket 39 seals the flange against the panel 2 when the lighting fixture 10 is mounted. The mounting housing is preferably formed from cast aluminium, or another material designed to meet regulatory requirements and allow for effective heat dissipation.

The light housing 40 is illustrated in FIGS. 8 to 11. The light housing 40 comprises a flange 42 complementary to the flange 26 of the mounting housing 20 and having openings 44 adapted to align with the recessed nuts 28 in the mounting housing flange 26. Mounted on the top surface 46 of the light housing 40 is the other male or female portion of the connector 36, for connection to the complementary portion of the connector 36 mounted into the junction box 30. As can be seen in the illustrated example, particularly FIGS. 8 and 9, the connector 36 can include a surface provided with conductive contacts, also as shown in FIG. 4. The flange 42 surrounds a recess 48 within which is mounted the emitter board 60 and a glass lens 70, as shown in FIG. 11. The emitter board 60, shown in FIG. 12, maybe a standard LED circuit board, designed to withstand the high temperatures generated by prolonged use of the LEDs 62 in the operation of the light fixture 10. The LEDs 62 are preferably arranged generally symmetrically around the emitter board 60, providing for a generally even distribution of heat and light when the light fixture 10 is active. The emitter board 60 fits into the recess 48 and is retained by the wires grommet 54 and Epoxy material (not shown) and the glass lens 70, which is in turn retained by lens retaining clips 50 if used and the Epoxy potting material. The glass lens 70 is preferably a diffusing lens, and is formed from tempered glass capable of withstanding the high heat generated by the LEDs 62 and with suitable impact resistance to meet regulatory requirements.

The emitter board 60 is assembled to the light housing 40 by placing the emitter board 60 within the recess 48 and coupling the ends of the circuit tracks (not shown) to the portion of the connector 36 mounted to the top surface of the light housing 40 via suitable conductors (not shown) extending through opening 54, 64 in the light housing 40 and emitter board 60, respectively. The glass lens 70 is placed over the emitter board 60 and embedded in the potting Epoxy material (not shown) in which the potting material after curing will secure, seal and retain the glass lens 70. In the final assembly of the lighting fixture 10, which comprises the mounting housing 20 and lighting housing 40, the lens retaining clips 50 are swivelled into place and tightened to retain lens in position. The clips 50 are optional and may be omitted, as in the embodiment of FIG. 10A.

The mounting housing 20 is inserted into a suitable opening in the panel 2 and affixed (for example by attaching nuts 22 to upstanding bolts 24). The main power supply conductors (not shown) are introduced into the junction box 30 through opening 32 and retained by a suitable wire clamp. Terminals 34*a* may be used to connect the mains power supply conductors to the portion of the connector 36 mounted into the junction box 30, and the panel 2 is mounted to the surface (for example, inside a fume hood above a cook surface). The light housing 40 is mounted to the mounting housing 20 by properly aligning the openings 44 in the flange 42 with the nuts 28 in the flange 26, at which point the connector portion 36 attached to the light housing 40 is properly aligned with the complementary portion of the connector 36 mounted inside the junction box 30. The light housing 40 is pressed into the mounting housing 20 so that the complementary portions of the connector 36 are attached or in contact, and screws 42*a* are threaded into the nuts 28 to maintain the light housing 40 in place.

Thereafter, if servicing is required the screws 42*a* can be removed and the light housing 40 pulled off of the mounting housing 20, allowing access to all wiring connections within the junction box 30. This facilitates maintenance of the light fixture 10, and changing of the complete lighting housing 40 or the emitter board 60 when required.

Preferably once the emitter board 60 has been soldered to the conductors (not shown) for coupling to the connector portion 36 mounted to the light housing 40, a potting compound such as epoxy is poured into the recess 48 over the emitter board 60 and the lens 70 is affixed in place before the potting compound (not shown) hardens. The potting compound encapsulates the emitter board 60 and seals the lens 70 into the recess 48, thus protecting the emitter board 60 and soldered connections from environmental influences such as temperature and humidity. This is particularly advantageous in an application such as a fume hood disposed above a cook top, where high temperature and humidity conditions generally prevail during use. At the same time, when the light fixture 10 is in use, heat is dissipated by the fins 38 into the fume hood, thus allowing the light fixture 10 to operate at acceptable temperatures.

To ensure an air tight seal after tightening of the 4 screws 72 between the two parts of final assembly of the lighting fixture 10, which comprises the mounting housing 20 and lighting housing 40, an elastomeric (for example silicon) gasket 71 is placed over flange 42 and trapped between flange 42 and flange 26 when the lighting housing 40 is affixed to the mounting housing 20.

The invention has been described in the context of a particular application, however its implementation is not so limited. The light fixture 10 of the invention may be used in other mounted applications.

Various embodiments of the present invention having been thus described in detail by way of example, it will be apparent to those skilled in the art that variations and modifications may be made without departing from the invention.

What is claimed is:

1. A lighting fixture comprising:

a mounting housing, comprising:

a junction box containing a first power connector portion;

a plurality of heat dissipation fins extending from the mounting housing;

a flange extending from an exterior of the mounting housing; and at least one mounting housing alignment feature; and a light housing, comprising:

an emitter board supporting a plurality of light emitting diodes electrically coupled to a second power connector portion complementary to the first power connector portion;

a flange surrounding a recess containing the emitter board, the recess being substantially filled with potting material and covered by a glass lens, the glass lens being retained in the light housing by the potting material;

at least one light housing alignment feature, the at least one mounting housing alignment feature and the at least one light housing alignment feature cooperating to direct the second power connector portion into electrical contact with the first power connector portion as the light housing is mounted to the mounting housing in a mounting direction.

2. The lighting fixture of claim 1, wherein the first or second power connector portions are accessible from an open end of the mounting housing, or from the junction box, or from both.

3. The lighting fixture of claim 1, wherein each of the first power connector portion and the second power connector portion comprises a contact surface generally parallel to the mounting direction, and the contact surface of the first power connector portion slidingly engages the contact surface of the second power connector portion as the flange of the light housing engages the flange of the mounting housing.

4. The lighting fixture of claim 1, wherein the at least one mounting housing alignment feature comprises a recess in an edge of the flange extending from the exterior of the mounting housing, and the at least one light housing alignment feature comprises a corresponding recess in an edge of the flange of the light housing.

5. The lighting fixture of claim 1, wherein the at least one mounting housing alignment feature comprises fastening members disposed in the flange extending from the exterior of the mounting housing, and the at least one light housing alignment feature comprises corresponding openings.

6. The lighting fixture of claim 1 whereby the electrical connector portions can be accessed through an exposed face of the mounting housing or through the junction box.

7. The lighting fixture of claim 1, wherein the at least one mounting housing alignment feature is situated on the flange of the mounting housing in fixed relation to the first power connection portion, and the at least one light housing alignment feature is situated on a flange of the light housing in fixed relation to the second power connector portion, and further wherein the first power connector portion slidingly engages and electrically couples to the second power connector portion as the flange of the light housing engages the flange of the mounting housing.

8. The lighting fixture of claim 1, the lighting fixture being adapted for mounting through a panel, wherein the flange extending from the exterior of the mounting housing comprises a first face and a second face, the first face engaging the flange of the light housing and the second face contacting a face of the panel when the lighting fixture is mounted, the junction box and the plurality of heat dissipation fins thereby extending through the panel when the lighting fixture is mounted.

9. The lighting fixture of claim 1, wherein the mounting housing comprises a recess for receiving an emitter board, the plurality of heat dissipation fins extending above the recess and from the junction box.

10. A method for mounting a lighting fixture, the lighting fixture comprising:

a mounting housing comprising a junction box containing a first power connector portion, a flange extending from an exterior of the mounting housing, at least one mounting housing alignment feature, and a plurality of heat dissipation fins extending from the mounting housing; and a light housing comprising an emitter board supporting a plurality of light emitting diodes electrically coupled to a second power connector portion complementary to the first power connector portion, a flange surrounding a recess containing the emitter board, the recess being substantially filled with potting material and covered by a glass lens, the glass lens being retained in the light housing by the potting material, and at least one light housing alignment feature, the method comprising the steps of:

in any order, connecting a power supply to the first power connector portion and mounting the mounting housing to a mounting surface;

positioning the light housing to align the at least one light housing alignment feature with the at least one mounting housing alignment feature;

pressing the light housing into the mounting housing in a mounting direction, the at least one light housing alignment feature cooperating with the at least one mounting housing alignment feature to direct the second power connector portion into electrical contact with the first power connector portion; and fastening the light housing to the mounting housing to maintain the light housing in place.

11. The method of claim 10, wherein the lighting fixture is mounted through a panel, the panel providing the mounting surface, wherein the flange extending from the exterior of the mounting housing comprises a first face and a second face, the first face engaging the flange of the light housing and the second face contacting the mounting surface, the junction box and the plurality of heat dissipation fins thereby extending through the panel when the mounting housing is mounted to the mounting surface.

12. The method of claim 11, wherein the each of the first power connector portion and second power connector portion comprises a contact surface generally parallel to the mounting direction, and the contact surface of the first power connector portion slidingly engages the contact surface of the second power connector portion as the flange of the light housing engages the flange of the mounting housing.

13. The method of claim 10, wherein the mounting housing comprises a recess for receiving an emitter board, the plurality of heat dissipation fins extending above the recess and from the junction box.

* * * * *